United States Patent [19]

Break

[11] Patent Number: 4,557,132

[45] Date of Patent: Dec. 10, 1985

[54] SHEET BENDING BRAKE

[75] Inventor: Douglas G. Break, Dearborn, Mich.

[73] Assignee: Tapco Products Company, Inc., Detroit, Mich.

[21] Appl. No.: 576,870

[22] Filed: Feb. 3, 1984

[51] Int. Cl.[4] ..... B21D 5/04

[52] U.S. Cl. ..... 72/319; 16/361

[58] Field of Search ..... 72/319-323, 72/388, 387, 465; 16/234, 364, 361, 360

[56] References Cited

U.S. PATENT DOCUMENTS

| | | | |
|---|---|---|---|
| 1,426,776 | 8/1922 | Riecken | 16/364 |
| 3,380,280 | 4/1968 | Wise | 72/319 |
| 4,116,034 | 9/1978 | Ruediger | 72/387 |
| 4,240,279 | 12/1980 | Rhoades | 72/319 |
| 4,282,735 | 8/1981 | Break | 72/319 |
| 4,383,430 | 5/1983 | Klaus | 72/319 |
| 4,445,356 | 5/1984 | Chubb et al. | 72/319 |

FOREIGN PATENT DOCUMENTS

| | | | |
|---|---|---|---|
| 1076608 | 3/1960 | Fed. Rep. of Germany | 72/320 |
| 2422456 | 12/1979 | France | 72/388 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprising a first longitudinally extending member having a clamping surface, a clamping member movable toward and away from the clamping surface for holding a workpiece in position for bending and a second member extending longitudinally with respect to said first member. Each of the first and second members have substantially the entire length of the longitudinal edges thereof formed with longitudinally spaced intermeshing integral projections, the projections on the second member having a plurality of aligned openings and the projections on the first member having a plurality of aligned openings comprising slots extending axially with respect to the longitudinal axis of said member. A hinge pin extends through the openings of the second member and the slots of the first member. The second member has a workpiece contacting portion spaced from the projections. The slots have a configuration such that as the second member is moved relative to said first member to bend a workpiece, the hinge pin is guided along said slots such that the contacting portion of said second member remains substantially in the same position relative to the workpiece.

32 Claims, 7 Drawing Figures

SHEET BENDING BRAKE

This invention relates to sheet bending brakes.

BACKGROUND AND SUMMARY OF THE INVENTION

In recent years, various structures have been provided to form a portable sheet bending brake for bending metal or plastic sheets such as are used in siding on homes and buildings. Typical patents comprise U.S. Pat. Nos. 3,161,223, 3,481,173, 3,482,427, 3,559,444, 3,817,075 3,872,755 and 4,321,817.

Such brakes comprise a fixed member on which the sheet is clamped and a movable bending member for bending the sheet. A major problem with respect to such sheet bending brakes is the tendency of the bending member to move relative to the portion of the sheet being bent and thereby mar the surface of the sheet.

In U.S. Pat. Nos. 3,161,223, the tendency to mar the surface of the sheet material was minimized by having the intermeshing integral projections between the fixed member and bending member which extend longitudinally and define the hinge that connects the bending member with the fixed member having the clamping surface, positioned so that all portions of the projections do not extend above the plane of the surface of the members when the surfaces are substantially aligned.

U.S. Pat. Nos. 3,481,174 and 3,482,427 were directed to an arrangement which included a floatable compensator on the bending member which engages the sheet material and as the bending member is swung to bend the sheet pivots so that the contact with the sheet material is maintained.

Among the objectives of the present invention are to provide a sheet bending brake that incorporates a novel construction for minimizing the marring of the surface of the sheet material during bending; which functions without the need for added parts; which can be manufactured at low cost; and which can be adapted to sheet material of various thickness; and which can be utilized in a novel fashion to provide a complete 180° bend to the sheet material.

In accordance with the invention, each of the fixed and movable bending members have substantially the entire length of the longitudinal edges thereof formed with longitudinally spaced intermeshing integral projections. The projections on the bending member having a plurality of aligned openings and the projections on the fixed member have a plurality of aligned openings comprising slots extending axially with respect to the longitudinal axis of said member. A hinge pin extends through the openings of said bending member and the slots of the fixed member. The slots have a configuration such that as the bending member is moved relative to the fixed member to bend a workpiece, the hinge pin is guided along said slots such that the contacting portion of the bending member remains substantially in the same position relative to the workpiece.

DESCRIPTION

Figure 1:
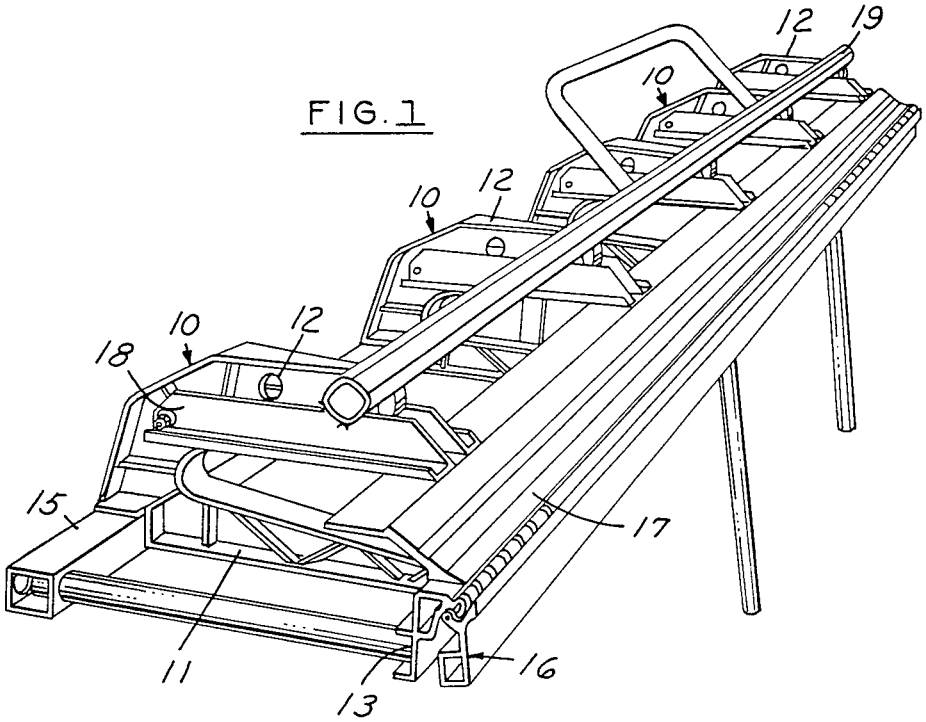
FIG. 1 is a perspective view of a sheet bending brake embodying the invention.
Figure 2:
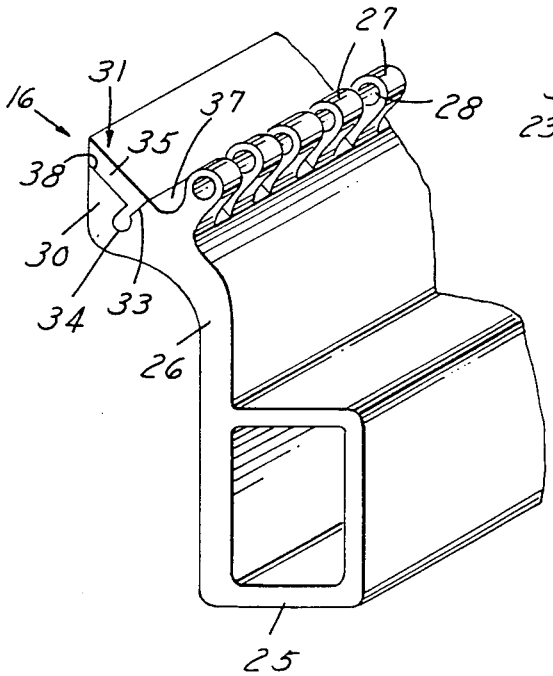
FIG. 2 is a fragmentary perspective view of a bending member utilized in the sheet bending brake.
Figure 3:
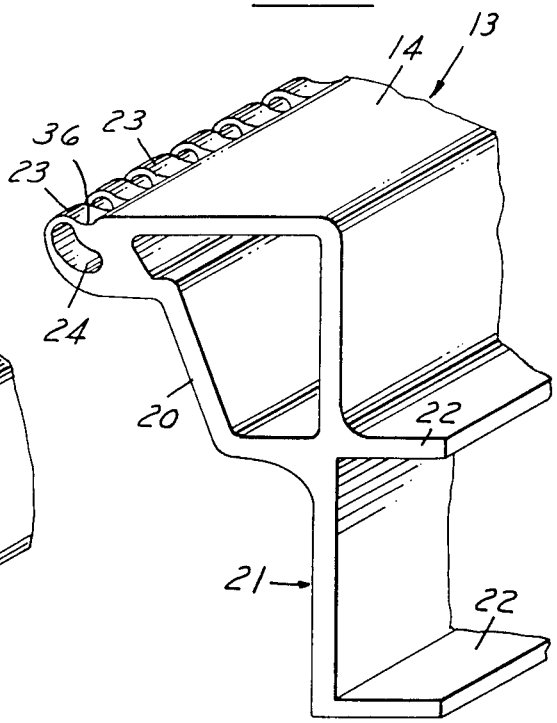
FIG. 3 is a fragmentary perspective view of a fixed member utilized in the sheet bending brake.
Figure 4:
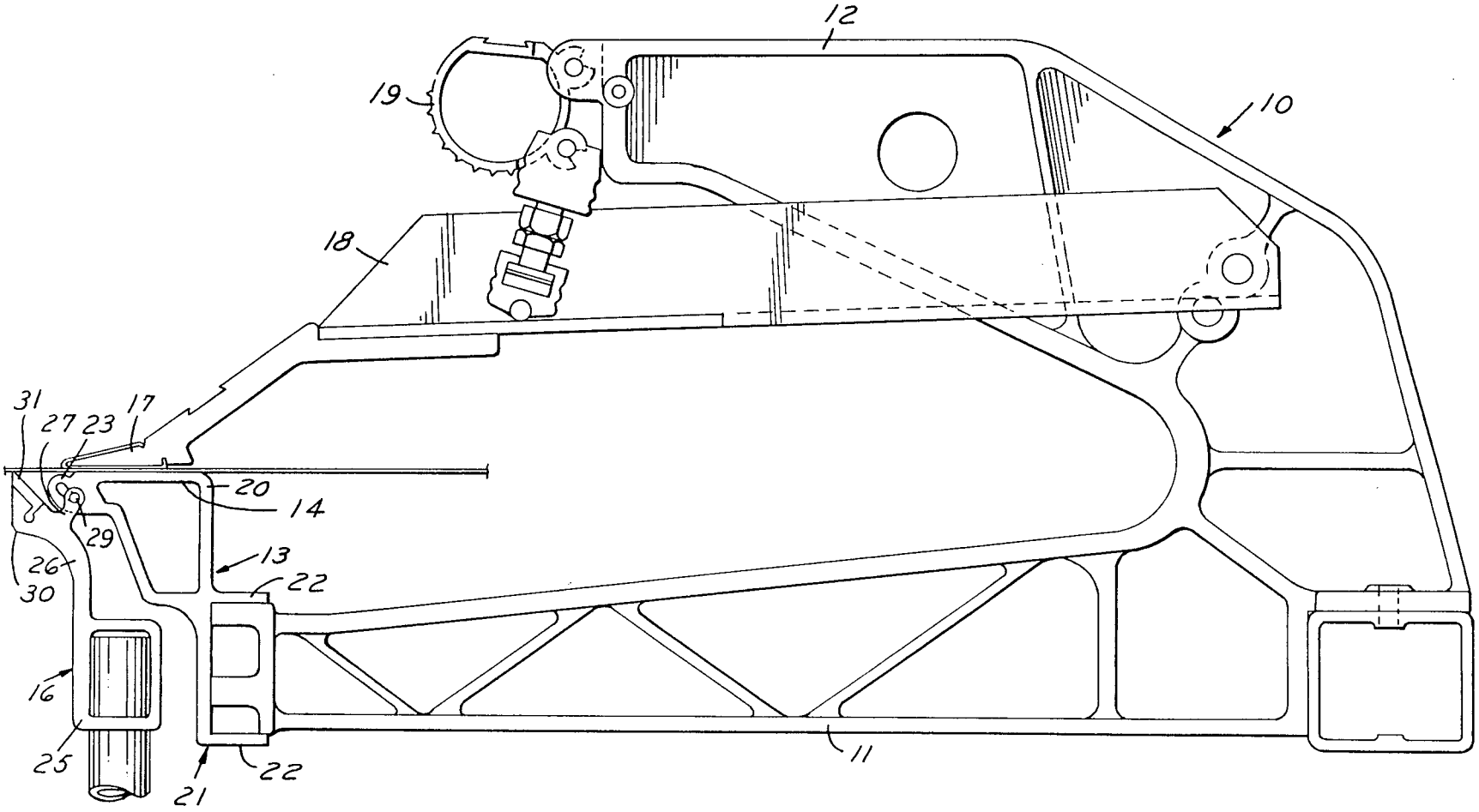
FIG. 4 is an end view of the sheet bending brake.

Referring to FIGS. 1–4, the sheet bending brake embodying the invention comprises longitudinally spaced C-shaped frame members 10. Each frame member includes a lower arm 11 and an upper arm 12 which overlies the lower arm 11 in spaced relation thereto. Legs may be provided as needed to support the brake above the floor or working area.

A first fixed member 13 is fixed on the ends of the free lower arms 11 and defines a clamping surface 14. Longitudinally spaced base rails 15 are fixed to the rear end of the lower arms 11. A second bending member 16 is hinged to the first member 13, as presently described, to provide a means for bending the sheet material.

Clamping member 17 extends longitudinally in overlying relationship to the clamping surface 14 of the first member 13. Means are provided for moving the anvil member toward and away from the clamping surface to clamp a workpiece on the clamping surface. The means for clamping the workpiece may comprise any of the structures set forth in the aforementioned United States Patents, incorporated herein by reference, but as herein shown comprise channel shaped pivot bars 18 pivoted on each frame member 10 with the clamping member 17 fixed thereto and a handle member 19 pivoted to the upper arm 12 of each C-frame member 10 and to the pivot bars 18 by a plurality of extensible links 19 pivoted at the upper edge to the handle member 19 and at the lower end to the pivot bars 18. The extensible links may be of the type shown in U.S. patent application Ser. No. 288,660 filed July 30, 1981, incorporated herein by reference.

In accordance with the invention, the first member 13 having the clamping surface 14 is formed as an aluminum extrusion and includes an upper tubular portion 20 and a lower portion 21 including spaced flanges 22 engaging the free ends of lower arms 11. A plurality of longitudinally spaced projections 23 are provided at the juncture of the portion 20 which defines the clamping surface 14. Each projection 23 has a slot 24 formed therein and the slots 24 of the various projections 23 are in longitudinal alignment. Each slot 24 has its lower ends spaced from the clamping surface A and extends outwardly and upwardly so that its upper end is generally near the plane of the clamping surface. Each slot 24 is preferably arcuate and has a center spaced from the clamping surface and preferably extends for substantially 90° .

The bending member 16 is also in the form of an extrusion including a tubular portion 25 and a longitudinally extending leg 26 with a plurality of longitudinally spaced projections 27 having openings 28 therein. The projections 27 of the bending member 16 mesh with the projections 23 of the fixed member 13 and a pin 29 extends through the openings 28 and slots 24 to hinge the bending member 16 to the fixed member 13. The bending member 16 further includes a portion 30 that extends upwardly and outwardly when the bending member 16 is in position for bending and has a contacting portion defined by a longitudinally extending plastic strip 31 positioned in a recess 32. The recess is generally L-shaped and the strip 31 includes a short leg 33 having an enlarged end portion 34 for holding the strip 31 and the other leg 35 thereof extends along the recess beyond the portion to define a sheet contacting portion. Strip is preferably made of polyurethane having a durometer of 60 on the A scale.

The fixed member 13 further includes a recess 36 extending longitudinally at the juncture of the clamping surface 14 and the projections 23. Recess 36 functions as a pocket into which any burrs may fall from a knife used for scoring the workpiece. The clamping surface 14 is spaced slightly above the projections 23 in order to minimize marring of the surface of the workpiece when it is inserted and removed.

The bending member 16 also includes a recess 37 extending longitudinally between the projections 27 and the contacting portion 31.

In use, a workpiece of sheet material is clamped against the clamping surface 14 and the bending member 16 is moved by swinging the handle bringing the contacting portion of the bending member 16 in engagement with the sheet material. As the bending member is swung upwardly, the hinge pin 29 on the bending member 16 moves along the slots 24 and is guided in a fashion such that the contacting portion maintains substantially the same relative position of contact thereby minimizing marring of the surface of sheet material.

Figure 5:
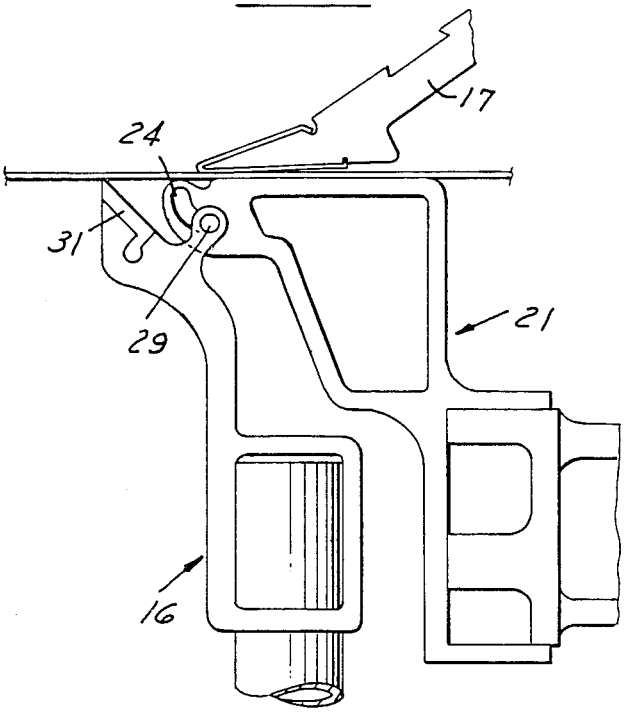
FIGS. 5, 6 and 7 are fragmentary views showing the relative positions of the parts during bending.
Figure 6:
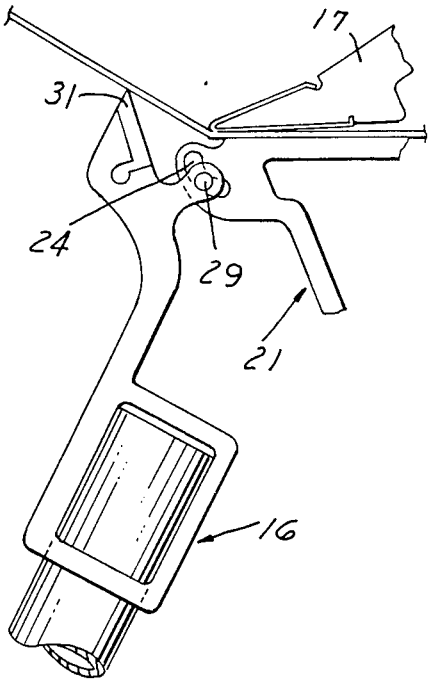
Figure 7:
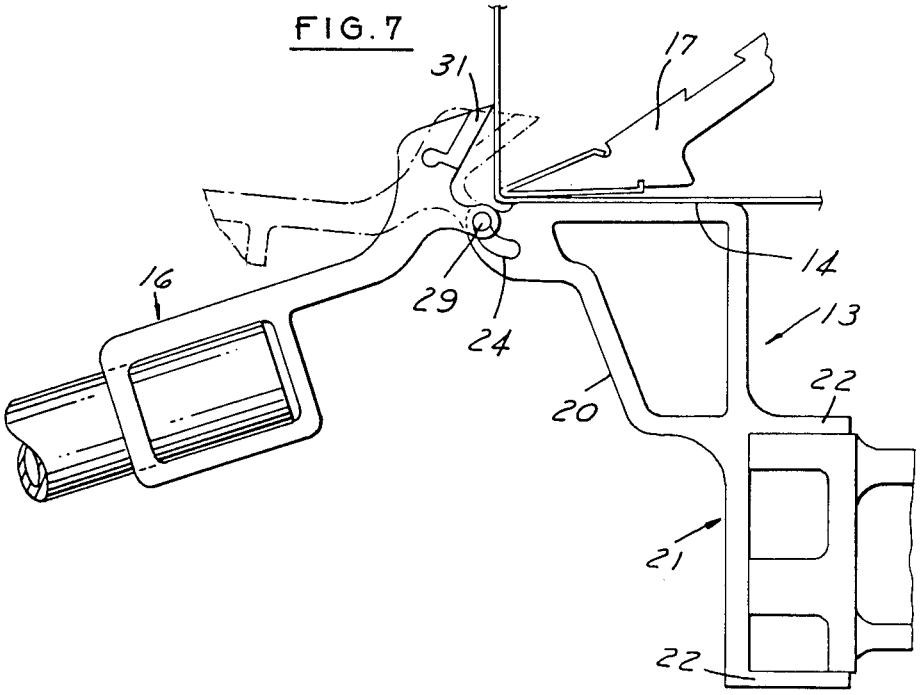

As shown in FIGS. 5, 6 and 7, the arcuate slots 24 extend generally from below the nose or bending edge of the clamping member upwardly and outwardly toward the user so that the hinge pin 16 moves along slots 24 as the workpiece is being bent until the hinge pin 29 reaches the upper end of the slots 24 (FIG. 6) after which the bending member 16 can be moved further to bend the workpiece into contact with the upper inclined surface of the clamping member 17.

Hemming can thereafter be achieved by unclamping the workpiece and placing the apex of the bend which has been formed on the workpiece in contact with the nose of the clamping member 16 and swinging the bending member 16 to compress and flatten the two bent portions of the workpiece against the upper surface of the clamping member 17.

In bending, the bend can be interrupted at any time and begin without marring the surface of the workpiece.

In addition, the workpiece can be bent with only a short portion extending beyond the nose of the clamping member 17, for example, a ¼".

The use of slots 24 also facilitates assembly of the hinge pin 29 and makes the member 13 easier to extrude.

I claim:

1. A sheet bending brake comprising a first longitudinally extending member having a clamping surface, means movable toward and away from the clamping surface for holding a workpiece in position for bending, a second member for bending a workpiece clamped on said clamping surface extending longitudinally with respect to said first member, each of said first and second members having substantially the entire length of the longitudinal edges thereof formed with longitudinally spaced intermeshing integral projections, the projections on said second member having a plurality of aligned openings, the projections on said first member having a plurality of aligned openings comprising slots extending axially with respect to the longitudinal axis of said member, a hinge pin extending through said openings of said second member and said slots of said first member, said second member having a fixed workpiece contacting portion spaced from the projections, said workpiece contact surface being fixed relative to said hinge pin, said slots having a configuration such that as the second member is moved relative to said first member to bend a workpiece, the hinge pin is guided along said slots such that the contacting portion of said second member remains substantially in the same position relative to the workpiece during the bending operation.

2. The sheet bending brake set forth in claim 1 wherein each said slot extends in an arc having one end spaced from the plane of the clamping surface and the other end extending generally to the plane of the clamping surface.

3. The sheet bending brake set forth in claim 2 wherein said slot has a constant radius.

4. The sheet bending brake set forth in claim 3 wherein said arcuate slot extends for about 90°.

5. The sheet bending brake set forth in claim 1 wherein said first member has a longitudinally extending recess between the projections and the contacting portion.

6. The sheet bending brake set forth in claim 1 wherein said second member has a longitudinally extending recess in the portion thereof defining the contacting portion, and a plastic strip is positioned in said recess and extends longitudinally of said second member to form a sheet contacting portion.

7. The sheet bending brake set forth in claim 6 wherein said recess is generally L-shaped, said strip having a generally complementary surface.

8. The sheet bending brake set forth in claim 7 wherein one leg of said L-shaped recess is enlarged.

9. The sheet bending brake set forth in claim 8 wherein the other leg of said recess is longer than the first leg, said strip having a portion thereof extending beyond the longitudinal edge of said recess.

10. The sheet bending brake set forth in claim 1 wherein said projections on said second member are spaced from the contact portion of said first member.

11. The sheet bending brake set forth in claim 1 wherein said second member includes a longitudinally extending leg extending outwardly from said projections and said contacting portion.

12. The sheet bending brake set forth in claim 11 including a tubular portion forming a part of said second member in association with said leg.

13. The sheet bending brake set forth in claim 1 wherein said first member comprises a first tubular portion extending longitudinally and having an outer surface defining said clamping surface, said projections on said first member extending outwardly from said first tubular portion.

14. The sheet bending brake set forth in claim 1 wherein said first member includes an integral portion for mounting said first member on a base.

15. The sheet bending brake set forth in claim 14 wherein said base includes a rail which is engaged by said first member.

16. A sheet bending brake comprising a base, a plurality of C-shaped members positioned on said base at longitudinally spaced points, each said C-shaped member comprising a lower arm fixed to said base and an upper arm spaced from and overlying said lower arm, a first member fixed on the lower arms of said C-shaped members and having a clamping surface, means for locking a piece of sheet material on said clamping surface, a second member for bending a workpiece clamped on said clamping surface extending longitudinally with respect to said first member, each of said first and second members having substantially the entire length of the longitudinal edges thereof formed with longitudinally spaced intermeshing integral projections, the projections on said second member having a plurality of aligned openings.

the projections on said first member having a plurality of aligned openings comprising slots extending axially with respect to the longitudinal axis of said member, a hinge pin extending through said openings of said second member and said slots of said first member, said second member having a fixed workpiece contacting portion spaced from the projections, said workpiece contact surface being fixed relative to said hinge pin, said slots having a configuration such that as the second member is moved relative to said first member to bend a workpiece, the hinge pin is guided along said slots such that the contacting portion of said second member remains substantially in the same position relative to the workpiece during the bending operation.

17. The sheet bending brake set forth in claim 16 wherein each said slot extends in an arc having one end spaced from the plane of the clamping surface and the other end extending generally to the plane of the clamping surface.

18. The sheet bending brake set forth in claim 17 wherein said slot has a constant radius.

19. The sheet bending brake set forth in claim 18 wherein said arcuate slot extends for about 90°.

20. The sheet bending brake set forth in claim 16 wherein said first member has a longitudinally extending recess between the projections and the contacting portion.

21. The sheet bending brake set forth in claim 1 wherein said second member has a longitudinally extending recess in the portion thereof defining the contacting portion, and a plastic strip is positioned in said recess and extends longitudinally of said second member to form a sheet contacting portion.

22. The sheet bending brake set forth in claim 21 wherein said recess is generally L-shaped, said strip having a generally complementary surface.

23. The sheet bending brake set forth in claim 22 wherein one leg of said L-shaped recess is enlarged.

24. The sheet bending brake set forth in claim 23 wherein the other leg of said recess is longer than the first leg, said strip having a portion thereof extending beyond the longitudinal edge of said recess.

25. The sheet bending brake set forth in claim 16 wherein said projections on said second member are spaced from the contact portion of said first member.

26. The sheet bending brake set forth in claim 16 wherein said second member includes a longitudinally extending leg extending outwardly from said projections and said contacting portion.

27. The sheet bending brake set forth in claim 26 including a tubular portion forming a part of said second member in association with said leg.

28. The sheet bending brake set forth in claim 16 wherein said first member comprises a first tubular portion extending longitudinally and having an outer surface defining said clamping surface, said projections on said first member extending outwardly from said first tubular portion.

29. The sheet bending brake set forth in claim 16 wherein said first member includes an integral portion for mounting said first member on a base.

30. The sheet bending brake set forth in claim 29 wherein said base includes a rail which is engaged by said first member.

31. A sheet bending brake comprising a first longitudinally extending member having a clamping surface, means movable toward and away from the clamping surface for holding a workpiece in position for bending, a second member for bending a workpiece clamped on said clamping surface extending longitudinally with respect to said first member, each of said first and second members having substantially the entire length of the longitudinal edges thereof formed with longitudinally spaced intermeshing integral projections, the projections on said second member having a plurality of aligned openings, the projections on said first member having a plurality of aligned openings comprising slots extending axially with respect to the longitudinal axis of said member, a hinge pin extending through said openings of said second member and said slots of said first member, said second member having a fixed workpiece contacting portion spaced from the projections, said workpiece contact surface being fixed relative to said hing pin, said slots extending upwardly and outwardly toward the bending member with one end of said slot extending below the plane of the clamping surface and clamping member and the other end of said slot terminating adjacent the plane of said clamping surface, such that as the second member is moved relative to said first member to bend a workpiece, the hinge pin is guided along said slots such that the contacting portion of said second member remains substantially in the same position relative to the workpiece during the bending operation.

32. A sheet bending brake comprising a first longitudinally extending member having a clamping surface, means movable toward and away from the clamping surface for holding a workpiece in position for bending, a second member for bending a workpiece clamped on said clamping surface extending longitudinally with respect to said first member, each of said first and second members having substantially the entire length of the longitudinal edges thereof formed with longitudinally spaced intermeshing integral projections, the projections on said second member having a plurality of aligned openings, the projections on said first member having a plurality of aligned openings comprising slots extending axially with respect to the longitudinal axis of said member, a hinge pin extending through said openings of said second member and said slots of said first member, said second member having a workpiece contacting portion spaced from the projections, said contacting portion being in a fixed position with respect to said hinge pin, said slots having a configuration such that as the second member is moved relative to said first member to bend a workpiece, the hinge pin is guided along said slots such that the contacting portion of said second member remains substantially in the same position relative to the workpiece during the bending operation.

* * * * *